US011309118B2

(12) United States Patent
Konishi et al.

(10) Patent No.: US 11,309,118 B2
(45) Date of Patent: Apr. 19, 2022

(54) COIL COMPONENT AND INDUCTOR

(71) Applicant: KYOCERA Corporation, Kyoto (JP)

(72) Inventors: Takanori Konishi, Yasu (JP); Hiroshi Hamashima, Hikone (JP)

(73) Assignee: KYOCERA Corporation, Kyoto (JP)

( * ) Notice: Subject to any disclaimer, the term of this patent is extended or adjusted under 35 U.S.C. 154(b) by 522 days.

(21) Appl. No.: 16/315,628

(22) PCT Filed: Jul. 5, 2017

(86) PCT No.: PCT/JP2017/024706
§ 371 (c)(1),
(2) Date: Jan. 4, 2019

(87) PCT Pub. No.: WO2018/008699
PCT Pub. Date: Jan. 11, 2018

(65) Prior Publication Data

US 2019/0318863 A1 Oct. 17, 2019

(30) Foreign Application Priority Data

Jul. 5, 2016 (JP) ..... JP2016-133634

(51) Int. Cl.
*H01F 17/04* (2006.01)
*H01F 27/26* (2006.01)
*H01F 27/28* (2006.01)
*H01F 41/02* (2006.01)

(52) U.S. Cl.
CPC ..... *H01F 27/263* (2013.01); *H01F 27/2823* (2013.01); *H01F 41/0206* (2013.01)

(58) Field of Classification Search
CPC ..... H01F 17/045; H01F 27/263
USPC ..... 336/221
See application file for complete search history.

(56) References Cited

U.S. PATENT DOCUMENTS

2017/0263373 A1* 9/2017 Ashizawa ..... H01F 17/045

FOREIGN PATENT DOCUMENTS

| | | | |
|---|---|---|---|
| JP | H7-302714 | A | 11/1995 |
| JP | H10-135048 | A | 5/1998 |
| JP | 2004-274038 | A | 9/2004 |
| JP | 2016-63195 | A | 4/2016 |

* cited by examiner

*Primary Examiner* — Ronald Hinson
(74) *Attorney, Agent, or Firm* — Procopio Cory Hargreaves and Savitch LLP

(57) ABSTRACT

There is provided a coil component which includes a core; and a plurality of leg portions provided at respective ends of the core, wherein each of the leg portions includes a protrusion which protrudes inward with respect to a joint between the core and the leg portion.

4 Claims, 8 Drawing Sheets

COIL COMPONENT AND INDUCTOR

TECHNICAL FIELD

The present disclosure relates to a coil component and an inductor.

BACKGROUND ART

In various kinds of electronic devices, many electronic components such as a capacitor, a chip resistor, and an inductor are mounted. Along with advance in miniaturization of a portable electronic device, also advance in miniaturization in those electronic components is being made. In many cases with those electronic components, an electrode of an electronic component is bonded to an electrode of a mounting body such as a printed wiring board. For such bonding to a mounting body, solder or the like is used for example.

Patent Document 1, for example, discloses one example of an inductor. An inductor includes a coil component which includes a core around which a conducting wire is to be wound and leg portions provided at respective ends of the core. The inductor in Patent Document 1 is configured in such a manner that a conducting wire is wound around the core of the coil component.

RELATED ART DOCUMENT

Patent Document

Patent Document 1: Japanese Unexamined Patent Publication No. 10-135048

SUMMARY OF THE INVENTION

A coil component according to the present disclosure is a coil component including a core and a plurality of leg portions provided at respective ends of the core, and each of the leg portions includes a protrusion which protrudes inward with respect to a joint between the core and the leg portion. The inductor according to the present disclosure includes the above-described coil component, a conducting wire wound around the core, and an electrode layer provided in each of the leg portions.

EMBODIMENTS FOR CARRYING OUT THE INVENTION

Figure 1A:
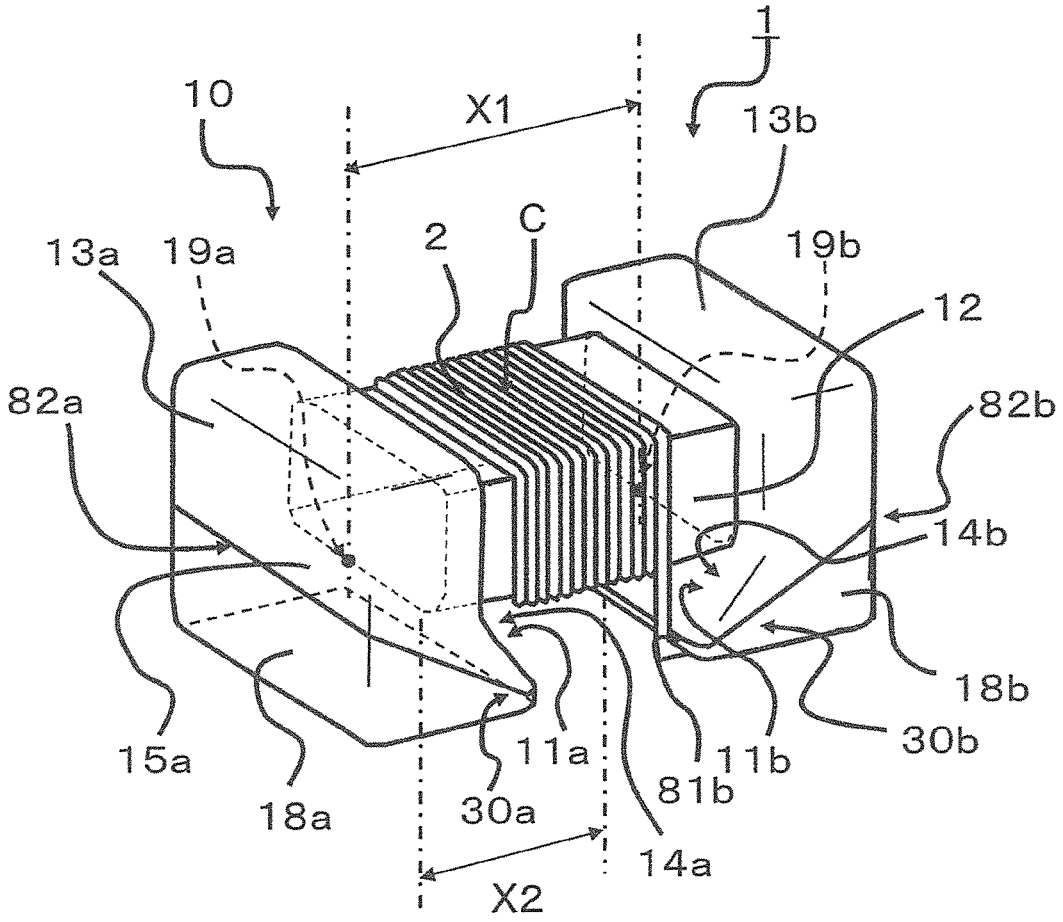
FIG. 1A is a perspective view of one embodiment of an inductor.

Some embodiments of a coil component and an inductor will be described in detail with reference to the drawings. In all of the drawings in the present specification, the same reference numerals are given to members having similar configurations and description thereof is omitted as appropriate unless confusion arises. It is noted that the drawings provide schematic representation, and dimensions, positional relationships, and the like of various kinds of structures in the drawings are not necessarily shown exactly.

Figure 1B:
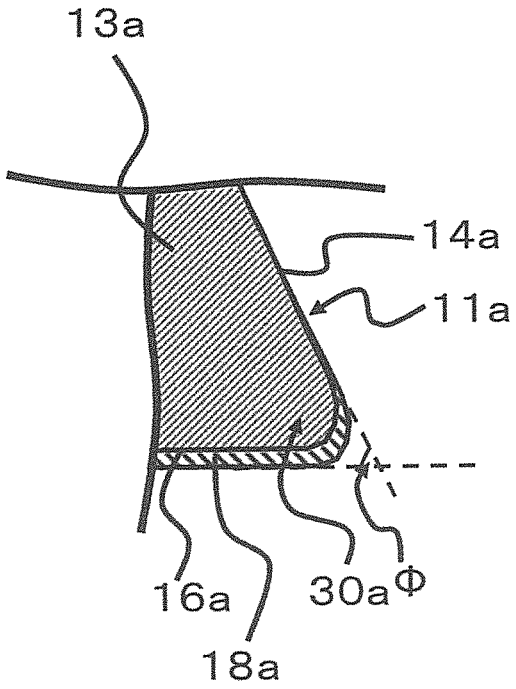
FIG. 1B is a partial sectional view of the one embodiment of the inductor.
Figure 1C:
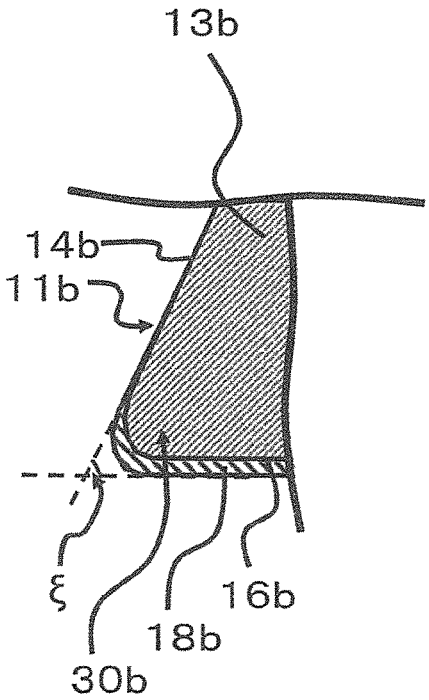
FIG. 1C is a partial sectional view of the one embodiment of the inductor.
Figure 2:
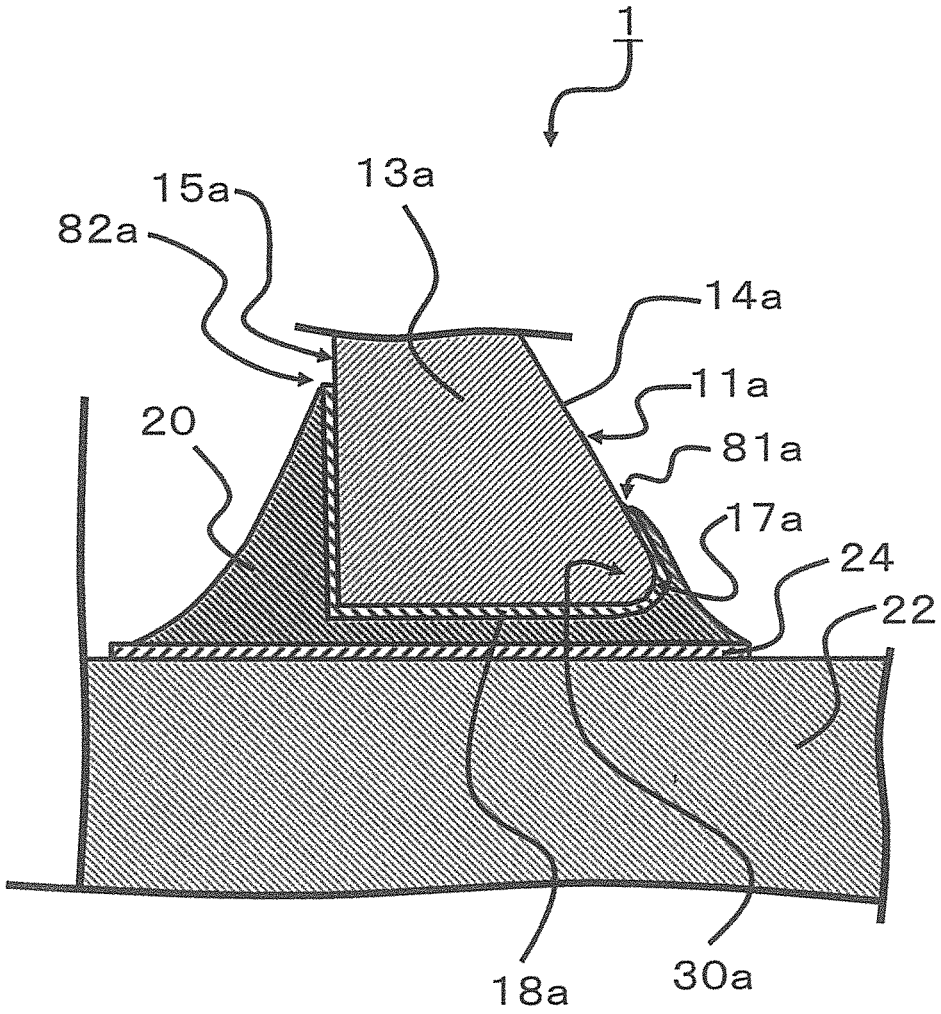
FIG. 2 is a partial sectional view showing an example of a state in which the one embodiment of the inductor is mounted.

FIG. 1 shows one embodiment of an inductor. FIG. 1(*a*) is a perspective view, FIG. 1(*b*) is an enlarged sectional view of a part of a left leg portion in FIG. 1(*a*), and FIG. 1(*c*) is an enlarged sectional view of a part of a left leg portion in FIG. 1(*a*). Also, FIG. 2 is an enlarged sectional view of principal parts in a state in which an inductor shown in FIG. 1 is mounted.

A coil component 10 forming an inductor 1 shown in FIG. 1 includes a core 12 and a plurality of leg portions (a leg portion 13*a* and a leg portion 13*b* in the present embodiment) which are provided at respective ends of the core 12. The leg portion 13*a* includes a protrusion 30*a* which protrudes inward with respect to a joint 19*a* between the core 12 and the leg portion 13*a*. Also, the leg portion 13*b* includes a protrusion 30*b* which protrudes inward with respect to a joint 19*b* between the core 12 and the leg portion 13*b*.

The coil component 10 shown in FIG. 1 is a component in a form of a so-called drum core. The inductor 1 includes a conducting wire 2 wound around the core 12, an electrode layer 18*a* provided in an end surface 16*a*, and an electrode layer 18*b* provided in an end surface 16*b*. The leg portion 13*a* includes the protrusion 30*a* which protrudes over a vertical line of the joint 19*a* between the core 12 and the leg portion 13*a*. Also, the leg portion 13*b* includes the protrusion 30*b* which protrudes over a vertical line of the joint 19*b* between the core 12 and the leg portion 13*b*. It is noted that the coil component 10 will be discussed as a main subject in the following description except portions dealing with an overall configuration, bonding to a mounted body, and the like.

The leg portion 13*a* includes an inner surface 14*a*, the leg portion 13*b* includes an inner surface 14*b*, and the inner surface 14*a* and the inner surface 14*b* face each other. The leg portion 13*a* includes an outer surface 15*a* opposite to the inner surface 14*a*, and the leg portion 13*b* includes an outer surface 15*b* opposite to the inner surface 14*b*.

The inner surface 14*a* includes an inclined surface 11*a* in a region corresponding to the protrusion 30*a*, and the inner surface 14*b* includes an inclined surface 11*b* in a region corresponding to the protrusion 30*b*. The leg portion 13*a* includes the end surface 16*a* which is shown as a lower surface in the drawing. The end surface 16*a* is continuous with the protrusion 30*a*. The leg portion 13*b* includes the end surface 16*b* which is shown as a lower surface in the drawing. The end surface 16*b* is continuous with the protrusion 30*b*. In the end surface 16*a*, the electrode layer 18*a* including a plating layer, for example, is provided. In the end surface 16*b*, the electrode layer 18*b* which includes a plating layer, for example, is provided.

In an example shown in FIG. 1, each of the end surface 16*a* and the end surface 16*b* is parallel to a lengthwise direction of the core 12. A vertical line of the joint 19*a* between the core 12 and the leg portion 13*a* is orthogonal to the end surface 16*a*. Also, a vertical line of the joint 19*b* between the core 12 and the leg portion 13*b* is orthogonal to the end surface 16*b*. The joint 19*a* is a portion where the inner surface 14*a* and the core 12 are in contact with each other, and the joint 19*b* is a portion where the inner surface 14*b* and the core 12 are in contact with each other. A length of the core 12 corresponds to a length between the joint 19*a* and the joint 19*b*.

The inclined surface 11*a* is inclined in such a manner that a distance to the end surface 16*b* of the leg portion 13*b* from the inclined surface 11*a* decreases as a distance to the end surface 16*a* from the core 12 decreases. The inclined surface 11*b* is inclined in such a manner that a distance to the end surface 16*a* of the leg portion 13*a* from the inclined surface 11*b* decreases as a distance to the end surface 16*b* from the core 12 decreases. Accordingly, in the coil component 10, a length X2 between the end surface 16*a* and the end surface 16*b* is smaller than a length of the core 12, the length being denoted by "X1" in FIG. 1.

The coil component 10 is a so-called 0402-size electronic component in which a length along a direction from the leg portion 13*a* toward the leg portion 13*b* is approximately 0.4 mm, and a length (height) along a direction from the end surface 16*a* toward a surface opposite to the end surface 16*a* is approximately 0.2 mm, for example. As a size and a form of the coil component 10 are not limited to any specific ones, a so-called 0603-size (0.6 mm long and 0.3 mm high) electronic component can be used and a form thereof is not limited to a form of a drum core.

FIG. 2 is an enlarged sectional view of principal parts in a state in which the inductor shown in FIG. 1 is mounted. As shown in FIG. 2, the inductor 1 is mounted in a mounted body 22 such as a printed wiring board, for example. The inductor 1 is bonded to a conductor layer 24 such as an electrode pad which is provided in a surface of the mounted body 22 and includes gold (Au) as a main ingredient, for example, via a bonding member 20 such as solder. It is noted that though only a side where the leg portion 13*a* is provided is selectively shown in FIG. 2, a side where the leg portion 13*b* is provided has a similar configuration. Hereinafter, only a side where the leg portion 13*a* is provided will be described as a representative.

The electrode layer 18*a* in the leg portion 13*a* is bonded to the conductor layer 24 of the mounted body 22 via the bonding member 20 such as solder. In a process for the bonding, molten metal such as reflowed solder, for example, easily wets, and spreads over, a whole of the electrode layer 18*a* having relatively good wettability. For example, in a case where molten metal wets and spreads over, the electrode layer 18*a* to such a degree that the molten metal lies off the electrode layer 18*a*, the bonding member 20 is electrically connected with the conducting wire 2 located in the core 12, so that an inductor function may be impaired in some cases. The leg portion 13*a* includes the inclined surface 11*a* in a region corresponding to the protrusion 30*a*, and the inclined surface 11*a* can suppress wetting up of molten metal, so that impairment of an inductor function can be suppressed.

Also, in the coil component 10, the leg portion 13*a* includes the protrusion 30*a*, and a cross-sectional area of the leg portion 13*a* at the protrusion 30*a* is relatively large. Accordingly, an area of the end surface 16*a* of the leg portion 13*a* is relatively large, so that an area of the electrode layer 18*a* is relatively large. As a result of this, an area where the electrode layer 18*a* and the conductor layer 24 of the mounted body 22 are bonded to each other is relatively large, so that bonding strength between the inductor 1 and the mounted body 22 is relatively high.

The electrode layer 18*a* includes an inner end line 81*a* located in the inner surface 14*a* of the leg portion 13*a*, and an outer end line 82*a* located in the outer surface 15*a*. A distance from the end surface 16*a* to the inner end line 81*a* may be smaller than a distance from the end surface 16*a* to the outer end line 82*a*. In such a case, it is possible to secure a large bonding area for the electrode layer 18*a* and the bonding member 20 and make bonding strength relatively high in the end line 82*a* which is located farther from the conducting wire 2, without impairing an inductor function, so that increased reliability can be attained.

In the coil component 10, each of an angle $\phi$ which is formed between the end surface 16*a* and the inclined surface 11*a* in the leg portion 13*a* as shown in FIG. 1(*b*) and an angle $\xi$ which is formed between the end surface 16*b* and the inclined surface 11*b* in the leg portion 13*b* as shown in FIG. 1(*c*) may be equal to or larger than 70 degrees and equal to or smaller than 80 degrees. In this case, wetting up of molten metal such as reflowed solder can be suppressed. Also in this case, concentration of stress around the joint 19*a* and the joint 19*b* can be relieved. The angle and the angle can be measured using observed images which are obtained by observation of sections shown in FIGS. 1 (*b*) and 1(*c*). More specifically, an angle between a virtual line along the end surface 16*a* and a virtual line along the inclined surface 11*a* can be measured. It is noted that in a case where it is difficult to cut the coil component 10 or a like case, a three-dimensional shape of the coil component 10 is measured, and an angle between a virtual line along the inclined surface 11*a* and a virtual line along the end surface 16*a* can be measured based on data of the measured three-dimensional shape.

Also, in the coil component 10, an intersecting portion 17*a* of the inclined surface 11*a* and the end surface 16*a* may be a curved surface. In this case, a creepage distance from the end surface 16*a* to the end line 81*a* is lengthened, so that bonding strength is enhanced. Also, by inclusion of the intersecting portion 17*a*, concentration of an electric field in the leg portion 13*a* can be relieved. A radius of curvature of the intersecting portion 17*a* is equal to or smaller than approximately 0.025 mm, for example. Also, stress is more likely to be concentrated in the intersecting portion 17*a* of the inclined surface 11*a* and the end surface 16*a* in a bonded state. In the inductor 1, since the intersecting portion 17*a* is a curved surface, concentration of stress applied to the intersecting portion 17*a* is relieved, so that mechanical breakage or fracture of the coil component 10 is suppressed.

The core 12, the leg portion 13*a*, and the leg portion 13*b* include ceramic which contains an aluminum oxide or ferrite as a main ingredient, for example. A main ingredient in ceramic means an ingredient occupying 70% by mass or higher in 100% by mass of ingredients forming ceramic, and particularly, it is preferable that a main ingredient occupies 80% by mass or higher. For identification of an ingredient (crystal structure) forming ceramic, an X-ray diffraction instrument can be used. Also, a content can be determined in terms of an oxide based on an identified crystal structure after determination of a content of a metallic element using an inductively coupled plasma (ICP) emission spectrometer or an X-ray fluorescence analyzer.

Figure 3A:
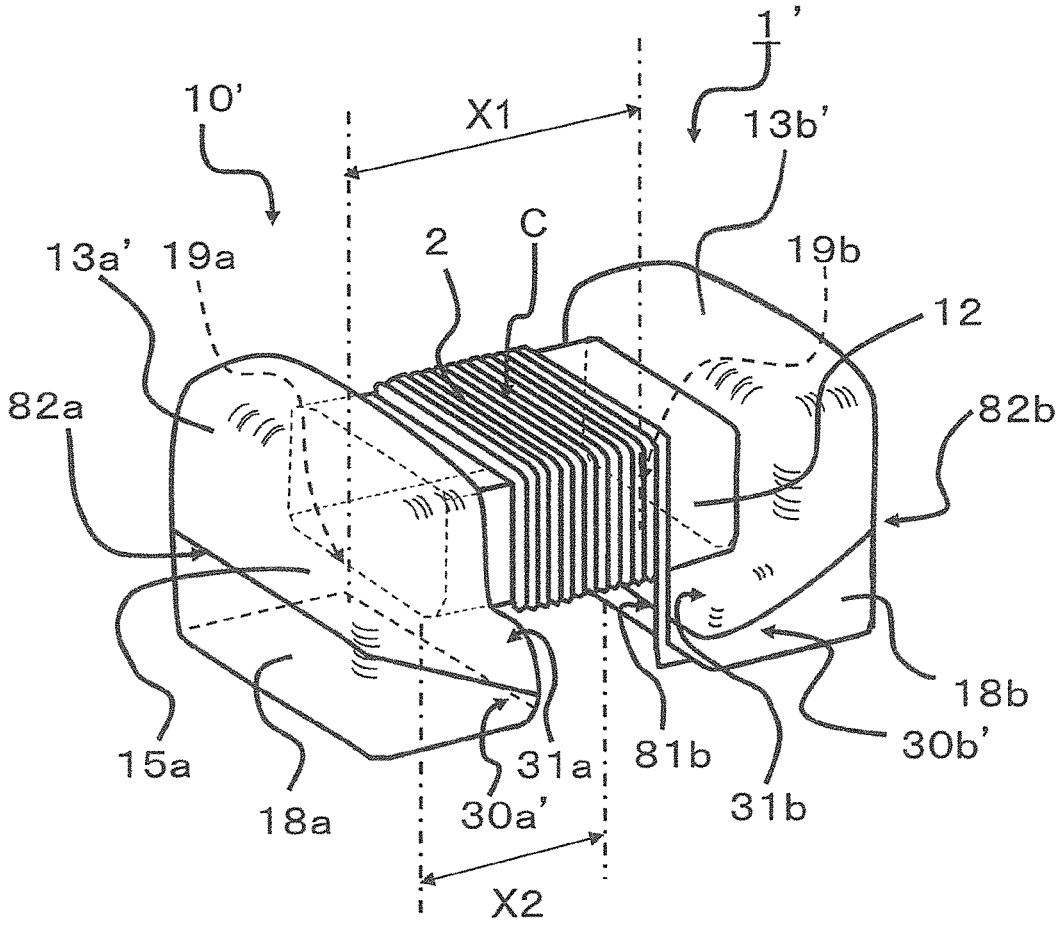
FIG. 3A is a perspective view of a different embodiment of an inductor.
Figure 3B:
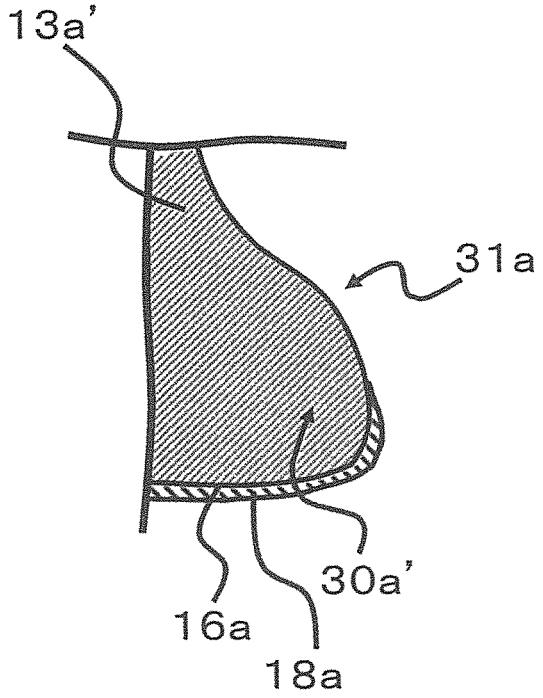
FIG. 3B is a partial sectional view of the different embodiment of the inductor.
Figure 3C:
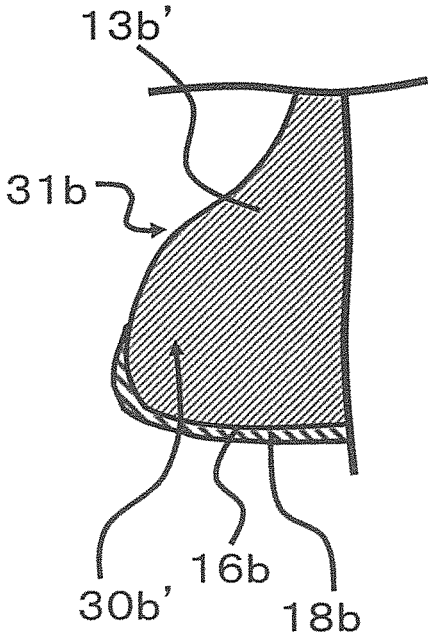
FIG. 3C is a partial sectional view of the different embodiment of the inductor.
Figure 4:
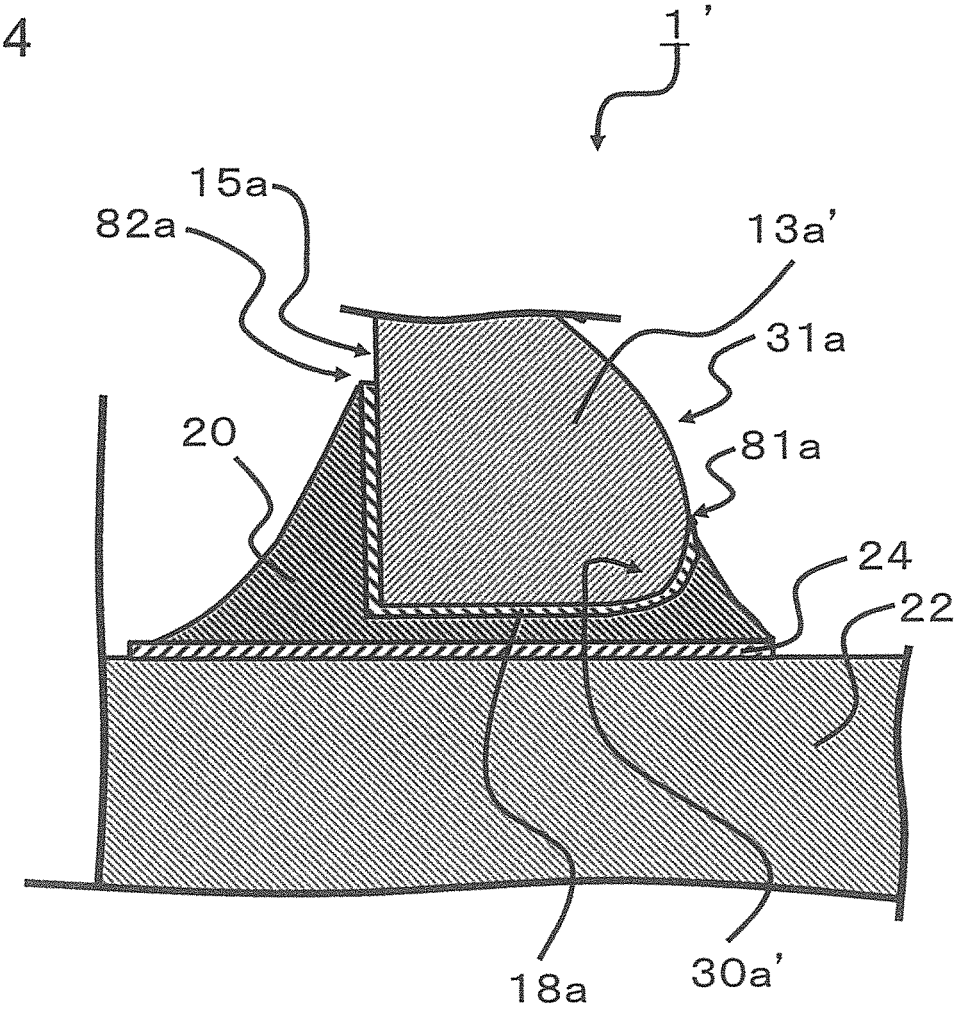
FIG. 4 is a partial sectional view showing an example of a state in which the different embodiment of the inductor is mounted.

FIG. 3 shows a different embodiment of an inductor. FIG. 3 (*a*) is a perspective view, FIG. 3 (*b*) is an enlarged sectional view of a part of a left leg portion in FIG. 3 (*a*), and FIG. 3(*c*) is an enlarged sectional view of a part of a right leg portion in FIG. 3 (*a*). Also, FIG. 4 is an enlarged sectional view of principal parts in a state where an inductor shown in FIG. 3 is mounted. In FIGS. 3 and 4, components similar to those in FIGS. 1 and 2 are shown with the use of the same reference numerals as those in FIGS. 1 and 2. It is noted that a coil component 10' will be discussed as a main subject also in the following description except portions dealing with an overall configuration and bonding to a mounted body.

The coil component 10' shown in FIG. 3 is different from the coil component 10 shown in FIGS. 1 to 2 in that each of a protrusion 30*a*' in a leg portion 13*a*' and a protrusion 30*b*' in a leg portion 13*b*' has a shape of rounded protrusion as a whole. The leg portion 13*a*' includes the protrusion 30*a*' which protrudes inward with respect to a joint 19*a*' between a core 12 and the leg portion 13*a*'. Also, the leg portion 13*b*' includes the protrusion 30*b*' which protrudes inward with respect to a joint 19*b*' between the core 12 and the leg portion 13*b*'. In the coil component 10', the protrusion 30*a*' includes a convexly-curved surface 31*a*, and the protrusion 30*b*' includes a convexly-curved surface 31*b*.

FIG. 4 is an enlarged sectional view of principal parts in a state in which an inductor 1' shown in FIG. 3 is mounted. Also in an example shown in FIG. 4, the inductor 1' is bonded to a conductor layer 24 such as an electrode pad which is provided in a mounted body 22 such as a printed wiring board and includes gold (Au) as a main ingredient, for example, via a bonding member 20 such as solder, to be used.

The inductor 1' is bonded to the conductor layer 24 such as an electrode pad which is provided in a surface of the mounted body 22 and includes gold (Au) as a main ingredient, for example, via the bonding member 20 such as solder. It is noted that though only a side where the leg portion 13*a*' is provided is selectively shown in FIG. 4, a side where the leg portion 13*b*' is provided has a similar configuration. Hereinafter, only a side where the leg portion 13*a*' is provided will be described as a representative. An electrode layer 18*a* in the leg portion 13*a*' is bonded to the conductor layer 24 of the mounted body 22 via the bonding member 20 such as solder. In a process for the bonding, molten metal such as reflowed solder, for example, easily wets, and spreads over, a whole of the electrode layer 18*a* having relatively good wettability.

The leg portion 13*a*' in the coil component 10' includes the convexly-curved surface 31*a*, and wetting up of molten metal at a time of bonding is more surely suppressed, so that a possibility of impairment of an inductor function is reduced.

Further, in the coil component 10', a cross-sectional area of the leg portion 13*a*' at a portion corresponding to the convexly-curved surface 31*a* is increased. Also an area of the end surface 16*a* of the leg portion 13*a*' is increased, so that an area of the electrode layer 18*a* is increased. Accordingly, an area where the electrode layer 18*a* and the conductor layer 24 of the mounted body 22 are bonded to each other is increased, so that bonding strength between the inductor 1' and the mounted body 22 is enhanced.

Further, in the coil component 10', the convexly-curved surface 31*a* may be continuous with the end surface 16*a*. Since the coil component 10' includes the convexly-curved surface 31*a*, a creepage distance from the end surface 16*a* to an end line 81*a* is relatively long, so that bonding strength is relatively high. Also, in a case where the convexly-curved surface 31*a* has a shape of a curved surface which is rounded as a whole or in a like case, portions in which an electric field is likely to be concentrated, such as an edged portion or a protrusion, are relatively small in number, so that concentration of an electric field in the leg portion 13*a*' is relieved. Likewise, in a case where the convexly-curved surface 31*a* has a shape of a curved surface which is rounded as a whole, portions in which stress is likely to be concentrated are small in number, so that mechanical breakage or fracture of the coil component 10' can be suppressed.

Next, an embodiment of a method for manufacturing a coil component and an inductor will be described. Firstly, description will be made with regard to a case where a coil component includes ceramic which contains an aluminum oxide as a main ingredient.

Firstly, aluminum oxide ($Al_2O_3$) powder, silicon oxide ($SiO_2$) powder as a Si source, calcium carbonate ($CaCO_3$) powder as a Ca source, and magnesium hydroxide ($Mg(OH)_2$) powder as an Mg source, are prepared. In this regard, those powders are weighed in such a manner that a content of Al in terms of $Al_2O_3$ amounts to 99.4% by mass or higher in 100% by mass of ingredients which form a coil component.

Then, aluminum oxide powder, silicon oxide powder, calcium carbonate powder, and magnesium hydroxide powder which amount to 100 parts by mass in total are mixed with 1 to 1.5 parts by mass of a binder such as polyvinyl alcohol (PVA), 100 parts by mass of a solvent, and 0.1 to 0.55 parts by mass of a disperser, so that a slurry is obtained.

Subsequently, after a slurry is subjected to spray drying and granules are obtained, the obtained granules are charged into a molding die and molded into a predetermined shape by a dry pressure forming process or the like. Then, a compact as obtained is maintained at a sintering temperature of 1450 to 1750° C. for two to five hours. After the above-described processes are performed, a coil component including ceramic which contains an aluminum oxide as a main ingredient can be obtained.

Next, description will be made with regard to a case where a coil component includes ceramic which contains ferrite as a main ingredient. Firstly, powder of each of oxides of Fe, Zn, Ni, and Cu, or powder of each metal salt such as carbonate, nitrate, and the like, from which oxides of Fe, Zn, Ni, and Cu are generated by sintering (such powder may be hereinafter also referred to as Fe source powder, Zn source powder, Ni source powder, and Cu source powder), is prepared. It is preferable that a mean particle size is in a range from 0.5 μm to 5 μm, inclusive, in a case where Fe is an iron oxide ($Fe_2O_3$), Zn is a zinc oxide (ZnO), Ni is a nickel oxide (NiO), and Cu is a copper oxide (CuO), for example.

Subsequently, for example, in a case where a composition range in 100 mole % of Fe, Zn, Ni, and Cu in terms of an oxide includes 49.5 mole % of Fe in terms of $Fe_2O_3$, 30.5 mole % of Zn in terms of ZnO, 12.5 mole % of Ni in terms of NiO, and 7.5 mole % of Cu in terms of CuO, Fe source powder, Zn source powder, Ni source powder and Cu source powder out of starting materials are weighed in such a manner that the above composition is attained, and are ground and mixed with one another with the use of a ball mill or the like. Then, calcination is conducted at a temperature of 700 to 1000° C. in the atmosphere, so that a calcined material is obtained.

Thereafter, the calcined material is put into a ball mill or the like together with water, and is ground and mixed with water. Then, a predetermined amount of binder or the like is added, so that a slurry is obtained. Subsequently, spray drying is conducted, so that granules are obtained. Then, the obtained granules are charged into a molding die, and a compact having a predetermined shape is obtained by a dry pressure forming process or the like. Subsequently, the compact is subjected to a degreasing process at a temperature of 400 to 800° C. in a degreasing furnace, to be converted into a degreased material, and thereafter, the degreased material is maintained at a sintering temperature of 1000 to 1200° C. for two to five hours. After the above-described processes are performed, a coil component including ceramic which contains ferrite as a main ingredient is obtained.

Next, a method for forming an electrode layer will be described. Firstly, a base layer is formed in an end surface of a leg portion of a coil component which is obtained by the above-described method. The base layer may be formed by application of paste which contains molybdenum as a main ingredient and also contains manganese and heat treatment at a temperature of 1400° C. in a reducing atmosphere, for example. After the base layer is formed, an electrode layer is formed on a surface of the base layer. The electrode layer may be formed by a barrel plating process, for example. The electrode layer contains nickel, gold, or tin, as a main ingredient, for example. Secondly, by winding a conducting wire around a core, it is possible to obtain an inductor.

In a manufacturing process such as a barrel plating process, in an inspecting process after manufacture, in the course of conveyance of completed products, or the like, for example, many coil components are collectively handled. For example, many coil components 10 are collectively put into a container for conveyance, and the container is conveyed. Within such a container, the plurality of coil components 10 are positioned randomly and collide with one another. In such a situation, the core 12 or the leg portion 13*a* of a certain coil component 10 is likely to enter between the leg portion 13*a* and the leg portion 13*b* of another coil component 10, and the certain coil component 10 may be sandwiched between the leg portion 13*a* and the leg portion 13*b*. When such sandwiching as described occurs, much time and much effort are expended in removing the sandwiched coil component, or if the sandwiched coil component cannot be released, there arises a need to dispose of the coil component as a defective in some cases. Amounts of time and effort associated with such sandwiching and a probability of occurrence of a defective increase as the coil component 10 becomes smaller. In contrast thereto, in the coil component 10 according to the present embodiments, the leg portion 13*a* includes the protrusion 30*a* and the leg portion 13*b* includes the protrusion 30*b*, so that a length between the leg portion 13*a* and the leg portion 13*b* is relatively small. Accordingly, the core 12, the leg portion 13*a*, or the like of a certain coil component 10 is unlikely to enter between the leg portion 13*a* and the leg portion 13*b* of another coil component 10. The coil component 10 according to the present embodiments suppresses sandwiching of a different coil component 10, so that much time and much effort which may be expended in the course of conveyance are saved, or occurrence of a defective resulted from sandwiching is suppressed, for example.

The present invention is not limited to the above-described embodiments, and various kinds of modifications, improvements, and the like are possible within the scope that does not depart from the essence of the present invention.

DESCRIPTION OF THE REFERENCE NUMERAL

1: Inductor
2: Conducting wire
10: Coil component
11*a*, 11*b*: Inclined surface
12: Core
13*a*, 13*b*: Leg portion
14*a*, 14*b*: Inner surface
15*a*, 15*b*: Outer surface
16*a*, 16*b*: End surface
18*a*, 18*b*: Electrode layer
17*a*, 17*b*: Intersecting portion
30*a*, 30*b*: Protrusion
31*a*, 31*b*: Convexly-curved surface

The invention claimed is:

1. An inductor comprising:
a core;
a plurality of leg portions provided at respective ends of the core; and
a conducting wire wound around the core,
wherein each of the leg portions includes a protrusion that protrudes inward with respect to a joint between the core and the leg portion,
the leg portion includes an end surface, an inner surface, an outer surface opposite to the inner surface, an intersecting portion in the shape of a curved surface located between the inner surface and the end surface, an electrode layer located on the intersection portion and having an inner end line located in the inner surface of the leg portion and an outer end line located in the outer surface of the leg portion, and a distance from the end surface to the inner end line being smaller than a distance from the end surface to the outer end line, and
the conducting wire includes a straight portion extending from the core to the intersection portions, the straight portion extending in a direction orthogonal to an axial direction of the core, at a distance from the leg portion, and terminating in an end portion connected to the electrode layer located on the intersecting portion.

2. The inductor according to claim 1, wherein
the protrusion includes a convexly-curved surface.

3. The inductor according to claim 1, wherein
the protrusion includes an inclined surface.

4. The inductor according to claim 3, wherein
an angle formed between an end surface of the leg portion and the inclined surface is equal to or larger than 70 degrees and is equal to or smaller than 80 degrees.

* * * * *